US006024626A

United States Patent [19]

Mendelsohn

[11] Patent Number: 6,024,626

[45] Date of Patent: Feb. 15, 2000

[54] MAGNETIC BLOCKS

[76] Inventor: Hillary Singer Mendelsohn, 479 Loring Ave., Los Angeles, Calif. 90024

[21] Appl. No.: 09/187,969

[22] Filed: Nov. 6, 1998

[51] Int. Cl.[7] ..... A63H 33/04

[52] U.S. Cl. ..... 446/92; 446/128; 446/85; 446/124

[58] Field of Search ..... 446/92, 124, 125, 446/120; 434/172

[56] References Cited

U.S. PATENT DOCUMENTS

| | | | |
|---|---|---|---|
| 1,430,557 | 10/1922 | Jervis | 446/85 |
| 2,795,893 | 6/1957 | Vayo | 446/92 |
| 2,872,754 | 2/1959 | Cronberger | 446/92 |
| 3,095,668 | 7/1963 | Dorsett | 446/92 |
| 3,184,882 | 5/1965 | Vega | 446/92 |
| 3,254,440 | 6/1966 | Duggar | 446/92 |
| 5,203,706 | 4/1993 | Zamir | 434/172 |
| 5,746,638 | 5/1998 | Shiraishi | 446/92 |

*Primary Examiner*—Robert A. Hafer
*Assistant Examiner*—Urszula M. Cegielnik

[57] ABSTRACT

A magnetic block including an upper face and a lower face and side faces therebetween and a plurality of magnets located within the blocks.

1 Claim, 3 Drawing Sheets

MAGNETIC BLOCKS

BACKGROUND OF THE INVENTION

1. Field of the Invention

The present invention relates to new and improved magnetic blocks and, more particularly, pertains to providing education and entertainment to children playing with blocks.

2. Description of the Prior Art

The use of blocks and building related toys of known designs and configurations is known in the prior art. More specifically, blocks and building related toys of known designs and configurations heretofore devised and utilized for the purpose of providing education and/or entertainment to children through known methods and apparatuses are known to consist basically of familiar, expected, and obvious structural configurations, notwithstanding the myriad of designs encompassed by the crowded prior art which has been developed for the fulfillment of countless objectives and requirements.

By way of example, a plurality of U.S. patents disclose magnets and blocks but none disclose a magnetic block as disclosed and claimed herein.

In this respect, the magnetic blocks according to the present invention substantially departs from the conventional concepts and designs of the prior art, and in doing so provides an apparatus primarily developed for the purpose of providing education and entertainment to children playing with blocks.

Therefore, it can be appreciated that there exists a continuing need for a new and improved magnetic blocks which can be used for providing education and entertainment to children playing with blocks. In this regard, the present invention substantially fulfills this need.

SUMMARY OF THE INVENTION

In view of the foregoing disadvantages inherent in the known types of blocks and building related toys of known designs and configurations now present in the prior art, the present invention provides a new and improved magnetic blocks. As such, the general purpose of the present invention, which will be described subsequently in greater detail, is to provide a new and improved magnetic blocks and methods which have all the advantages of the prior art and none of the disadvantages.

To attain this, the present invention essentially comprises a new and improved set of magnetic blocks for providing education and entertainment to a child playing with such blocks comprising, in combination a plurality of cube-shaped blocks having parallel front and rear faces, parallel side faces and parallel upper and lower faces. The upper face is coupled to the remainder of the block during operation and use. Four elongated recesses vertically extend within the block between the front and rear faces. A cylindrical bar magnet is located within each recess for magnetically coupling blocks to each other. A hemispherical recess is located in the upper face and a hemispherical projection on the lower face for positioning blocks with respect to each other. A plurality of triangular blocks having three square faces and triangular upper and lower faces with magnetic bars are located therein between the upper and lower faces. A plurality of rectilinear boxes having square front and rear faces and elongated rectangular side faces and elongated upper and lower faces with a pair of hemispherical projections on the top face and a pair of hemispherical projections on the lower face with magnetic bars located between the upper and lower faces with plural hemispherical recesses in the upper face and hemispherical projections on the lower face for positioning blocks with respect thereto.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved magnetic blocks which has all the advantages of the prior art blocks and building related toys of known designs and configurations and none of the disadvantages.

It is another object of the present invention to provide a new and improved magnetic blocks which may be easily and efficiently manufactured and marketed.

It is a further object of the present invention to provide a new and improved magnetic blocks which is of a durable and reliable construction.

An even further object of the present invention is to provide a new and improved magnetic blocks which is susceptible of a low cost of manufacture with regard to both materials and labor, and which accordingly is then susceptible of low prices of sale to the consuming public, thereby making such a magnetic blocks economically available to the buying public.

Even still another object of the present invention is to providing education and entertainment to children playing with blocks.

Lastly, it is an object of the present invention to provide a magnetic block including an upper face and a lower face and side faces therebetween and a plurality of magnets located within the blocks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
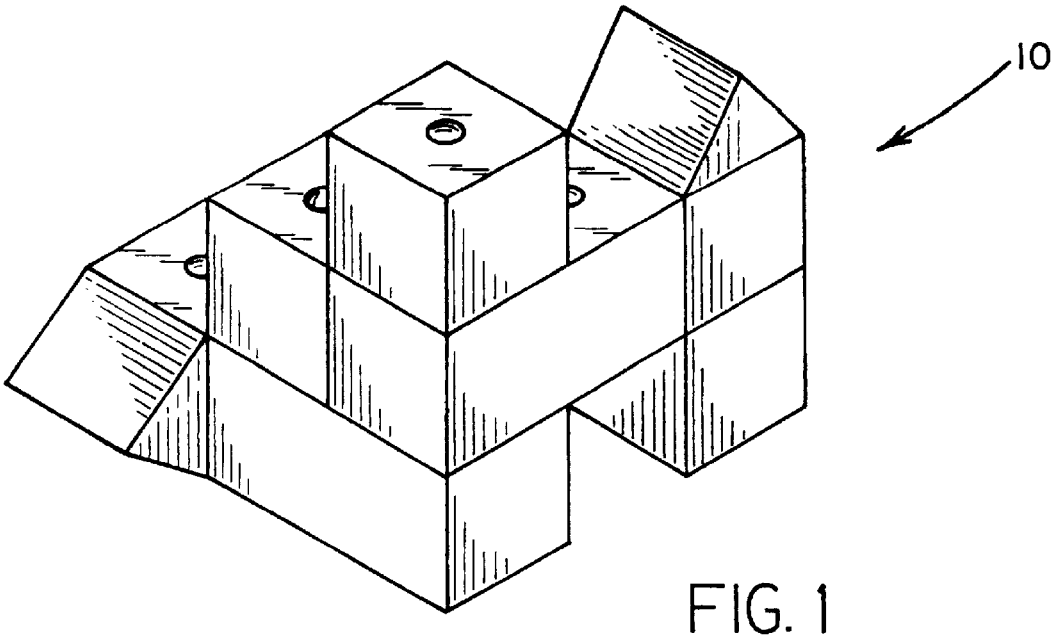
FIG. 1 is a perspective illustration of the preferred embodiment of the magnetic blocks constructed in accordance with the principles of the present invention.
Figure 2:
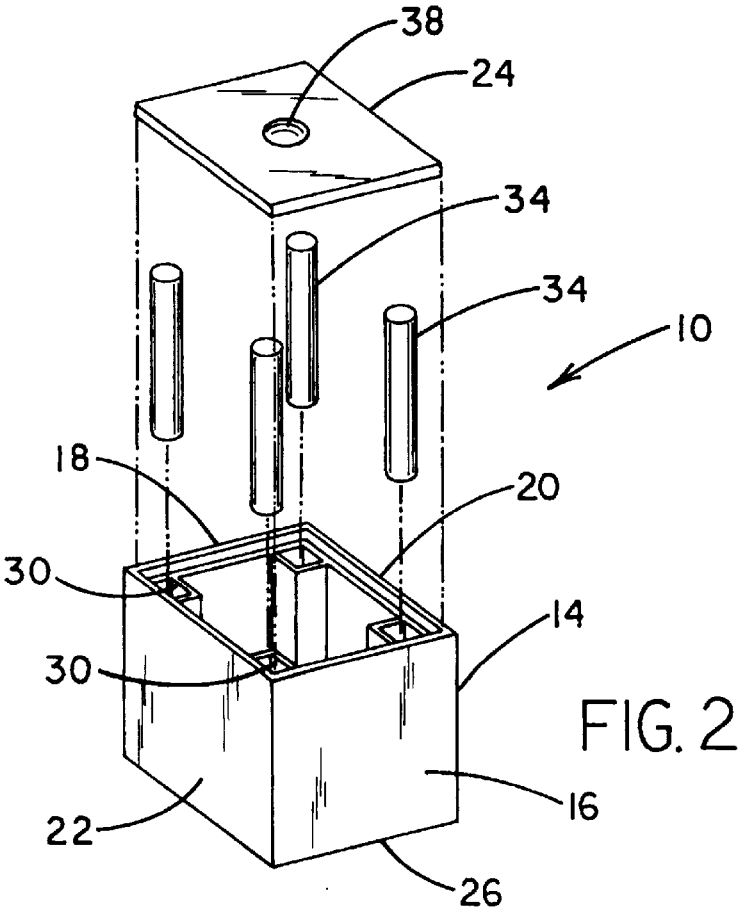
FIG. 2 is an exploded perspective view of one of the blocks constructed in accordance with the principles of the present invention.
Figure 3:
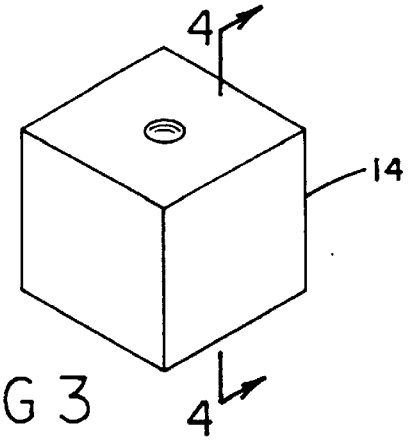
FIG. 3 is a perspective illustration shown in FIG. 1.
Figure 4:
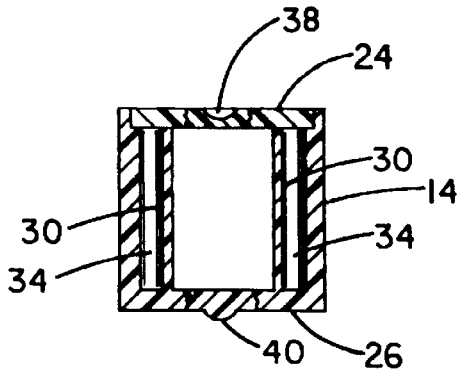
FIG. 4 is a cross-sectional view taken along line 4—4 of FIG. 3.

With reference now to the drawings, and in particular to FIGS. 1 through 11 thereof, the preferred embodiments of the new and improved magnetic blocks embodying the principles and concepts of the present invention and generally designated by the reference numeral 10 will be described.

The present invention, the new and improved magnetic blocks is a system 10 comprised of a plurality of components. Such components, in their broadest context, include a plurality of cube-shaped blocks, four elongated recesses, a cylindrical bar magnet and a hemispherical recess. Each of the individual components is specifically configured and correlated one with respect to the other so as to attain the desired objectives.

A new and improved set of magnetic blocks as disclosed herein is for providing education and entertainment to a child playing with such blocks. Such blocks comprise, in combination, a plurality of cube-shaped blocks 14. Each block has parallel front and rear faces 16, 18, parallel side faces 20, 22 and parallel upper and lower faces 24, 26. The upper face is coupled to the remainder of the block during operation and use.

Four elongated recesses 30 extend vertically within the block between the front and rear faces. The recesses are preferably formed integrally with the side and bottom faces.

A cylindrical bar magnet 34 is located within each recess. The magnets function to magnetically couple the blocks to each other.

A hemispherical recess 38 is positioned in the upper surface of the upper face. A hemispherical projection 40 is positioned on the lower surface of the lower face. The projection and recess function to position the blocks with respect to each other.

A plurality of triangular blocks 44 are next provided. Note FIGS. 7 and 8. Each has three square faces 46 and triangular upper and lower faces 48, 50. Magnetic bars are located therein between the upper and lower faces as in the prior embodiment.

Figure 5:
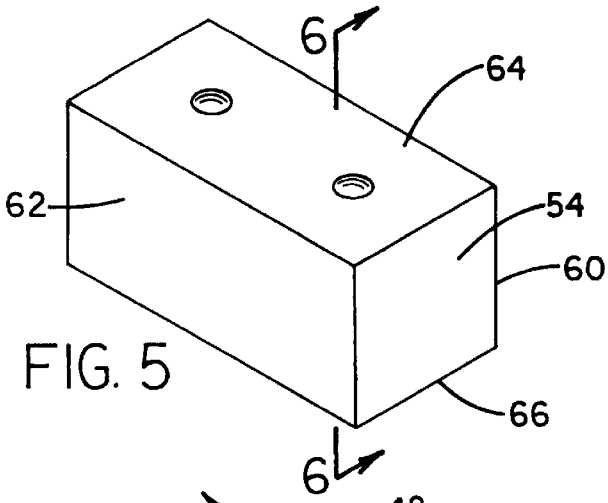
FIG. 5 is a perspective view of a rectilinear block as shown in FIG. 1.
Figure 6:
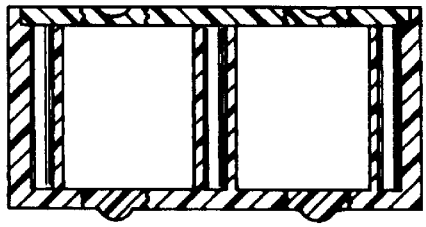
FIG. 6 is a cross-sectional view taken along line 6—6 of FIG. 5.
Figure 7:
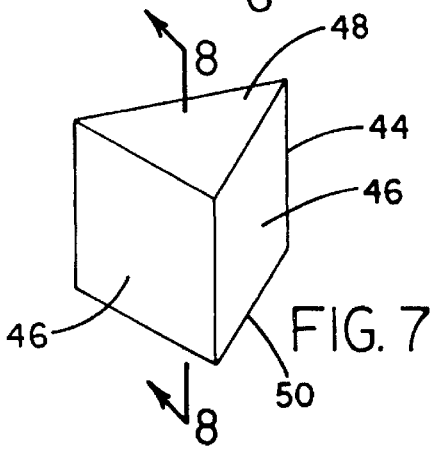
FIG. 7 is a perspective view of a right angular block as shown in FIG. 1.
Figure 8:
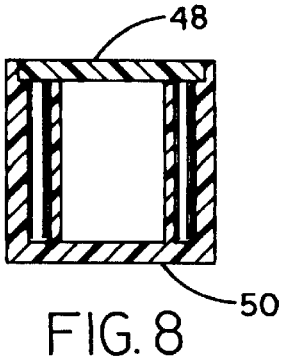
FIG. 8 is a cross-sectional view taken along line 8—8 of FIG. 7.
Figure 9:
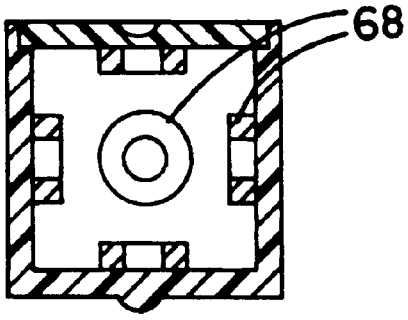
FIGS. 9, 10 and 11 are cross-sectional views of a block shown in FIGS. 3–8 but with the magnets illustrated as disc-shaped magnets rather than cylindrical bar magnets.
Figure 10:
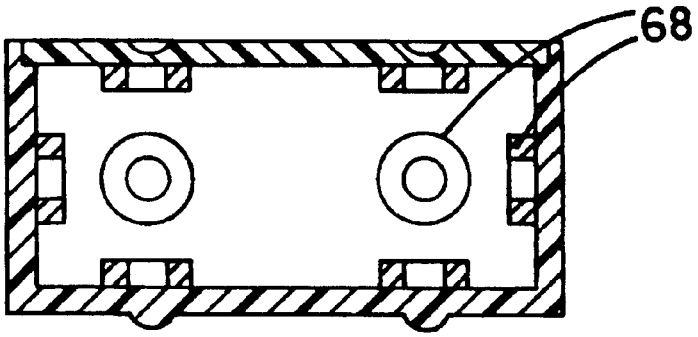
Figure 11:
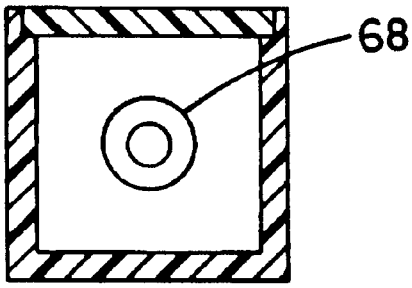

The embodiment of FIGS. 5 and 6 includes a plurality of rectilinear boxes 54 having square front and rear faces and elongated rectangular side faces 60, 62 and elongated upper and lower faces 64, 66. A pair of hemispherical projections are located on the top face and a pair of hemispherical projections are located on the lower face. Magnetic bars are located between the upper and lower faces.

As shown in FIG. 1, the blocks of the various configurations can be used together in a common building situation or they may be used individually without the other types of blocks. Further, as shown in the alternate embodiments of FIGS. 9, 10 and 11, the cylindrical bar-shaped magnet may take the form of disc-shaped magnets 68 with holes therethrough. The disc-shaped magnets are preferably glued or otherwise adhered to the interior faces of the walls that make up the block.

The magnet blocks of the present invention have permanent magnets inside to allow the blocks to stick together. The set of blocks will be composed of some combination of blocks which have either a projected rectangular shape, a cubical shape or a projected triangular shape. The rectangular blocks will be twice the size of the cubical blocks to allow them to fit together easily.

The blocks may also have "locators" to help to align the blocks when they are stacked. The locators will consist of a hemispherical recess or protrusion on the top and bottom sides o the block, but not on the sides of the block to facilitate molding and use of the block. The hemispherical protrusion will nest inside of the hemispherical recess when the blocks are stacked.

The magnetic blocks will be manufactured in either of two embodiments. The bar magnet system uses bar magnet s in the blocks. The blocks will consist of a plastic shell made in two pieces a top and a bottom. The bottom piece will be a hollow box with no top and recesses to hold the magnets in place. The bar magnets will be dropped into the bottom piece and will be held in place when the top piece is fastened in place using glue, screws, ultrasonic welding or other means.

In the cube, four bar magnets will be placed in the cube at each corner of the cube with the long dimension of the bar going up and down, and so that the upward facing poles of diagonally opposite bars are the same, i.e. either North or South. By using this configuration, each side of the cubical block may be fastened to each side of any other cubical block.

In the rectangle, six bar magnets will be placed in the rectangular block with the long dimensions of the magnets running up and down. The magnets will be placed in the four corners and midway along the long side of the rectangular face. The polarity of the magnets will alternate north and south along the perimeter of the upper rectangle of the block, so that the rectangular blocks may be stacked in either a staggered brick like pattern or directly on top of each other.

In the triangular block, three bar magnets will be placed with the long dimension of the magnets running up and down. The magnets will be place in the three corners with two upward facing poles having one polarity and the third upwardly facing pole having the other polarity. In this way, two of the square faces of the triangular block will have diagonally identical poles and will connect readily with either the square of the face of the cubical block or the sides of the rectangular block.

The disc magnet system uses disk magnets in the blocks. The blocks will consist of a plastic shell made in two piece; a top and a bottom. The bottom piece will be a hollow box with no top and will use either molded ribs or adhesive to hold the magnets in place.

In the cube-shaped blocks, there will be six magnets, with one magnet placed in the center of each of the sides of the cube. Each cube will have three North poles facing out and three South poles facing out, with the outer opposite faces of the cube having opposite polarity.

In the rectangular shaped blocks, there will be ten disk magnets, with one magnet placed at the center of each of the square sides of the block and two magnets placed along the center line of the rectangular sides of the block, and spaced ½ the short side length of the rectangular block from the edge of the block. This will allow cubical blocks to readily be stacked on top of the rectangular shaped blocks. Five magnets will have north poles facing outside of each block and five magnets will have south poles facing outside of each block.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved set of magnetic blocks for providing education and entertainment to a child playing with such blocks comprising, in combination:

a plurality of cube-shaped blocks having parallel front and rear faces, parallel side faces and parallel upper and lower faces, the upper face being coupled to the remainder of the block during operation and use;

four elongated recesses vertically extending within the block between the front and rear faces;

a cylindrical bar magnet located within each recess for magnetically coupling blocks to each other;

a hemispherical recess in the upper face and a hemispherical projection on the lower face for positioning blocks with respect to each other;

a plurality of triangular blocks having three square faces and triangular upper and lower faces with magnetic bars located therein between the upper and lower faces; and a plurality of rectilinear boxes having square front and rear faces and elongated rectangular side faces and elongated upper and lower faces with a pair of hemispherical recesses on the top face and a pair of hemispherical projections on the lower face with magnetic bars located between the upper and lower faces with plural hemispherical recesses in the upper face and hemispherical projections on the lower face for positioning blocks with respect thereto.

* * * * *